US011617922B2

(12) United States Patent
Mumford

(10) Patent No.: US 11,617,922 B2
(45) Date of Patent: Apr. 4, 2023

(54) KNEE ASCENDER CLIMBING APPARATUS WITH REMOVABLE TETHER

(71) Applicant: Richard Dean Mumford, Acworth, GA (US)

(72) Inventor: Richard Dean Mumford, Acworth, GA (US)

(73) Assignee: Climbing Innovations LLC, Acworth, GA (US)

( * ) Notice: Subject to any disclaimer, the term of this patent is extended or adjusted under 35 U.S.C. 154(b) by 367 days.

(21) Appl. No.: 16/885,212

(22) Filed: May 27, 2020

(65) Prior Publication Data

US 2020/0376342 A1 Dec. 3, 2020

Related U.S. Application Data

(60) Provisional application No. 62/853,158, filed on May 27, 2019.

(51) Int. Cl.
*A63B 27/02* (2006.01)
*A63B 29/02* (2006.01)

(52) U.S. Cl.
CPC ..... *A63B 27/02* (2013.01); *A63B 29/02* (2013.01)

(58) Field of Classification Search
CPC ..... A63B 27/02; A63B 29/02; A63B 2209/10; A63B 2225/09
See application file for complete search history.

(56) References Cited

U.S. PATENT DOCUMENTS

| | | | | |
|---|---|---|---|---|
| 4,667,772 | A * | 5/1987 | Kammerer | A62B 35/04 24/136 L |
| 5,400,869 | A * | 3/1995 | Rocourt | A62B 1/14 182/5 |
| 6,488,267 | B1 * | 12/2002 | Goldberg | A63B 29/02 254/264 |
| 9,352,190 | B2 * | 5/2016 | Frankhauser | A63B 29/02 |
| 9,643,054 | B2 * | 5/2017 | Frankhauser | A62B 1/14 |
| 10,052,521 | B1 * | 8/2018 | Mumford | A63B 29/02 |
| 11,273,345 | B1 * | 3/2022 | Mumford | A63B 27/00 |
| 2006/0231437 | A1 * | 10/2006 | Hull | B63B 21/04 206/388 |
| 2013/0133981 | A1 * | 5/2013 | Spraggon | A63B 27/00 182/134 |
| 2015/0251057 | A1 * | 9/2015 | Frankhauser | A62B 1/14 182/134 |
| 2016/0016042 | A1 * | 1/2016 | Maurice | A63B 29/02 188/65.2 |
| 2016/0059080 | A1 * | 3/2016 | Frankhauser | A63B 29/02 182/134 |

* cited by examiner

*Primary Examiner* — David M Upchurch
(74) *Attorney, Agent, or Firm* — Nova Intellectual Property Solutions LLC

(57) ABSTRACT

Knee ascenders that include modular replaceable components are described. The knee ascender has an elastic piece that provides pulling force to move the knee ascender upwards and is not secured to any of the other components of the knee ascender, making replacing the elastic piece that is subject to frequent wear and tear convenient. Additionally, the length of the load bearing member, the elastic piece, as well as the guiding piece of the elastic bearing member can be adjustable, making the knee ascender suites climber's many different needs.

20 Claims, 7 Drawing Sheets

KNEE ASCENDER CLIMBING APPARATUS WITH REMOVABLE TETHER

TECHNICAL FIELD

The present disclosure is directed to a climbing apparatus used in rope climbing, and methods of using such apparatus.

BACKGROUND

Knee ascender when used in combination with a foot ascender, allows a climber to alternate his or her strides when climbing up a rope and thus improves the climber's overall climbing experience and efficiency. Generally, a knee ascender has a cam bearing member to engage with a rope when weight is applied on the cam and to disengage the rope when the weight is relieved from the cam, a load bearing member to lock in the cam of the cam bearing member when a climber applies weight to the load bearing member and the cam bearing member through a foot attachment so the climber could move upward, and an elastic piece to pull the ascender upward when the climber alternates the stride to shift the weight to the other foot.

Many of the existing knee ascenders have the elastic piece secured relative to the load bearing member. This "fixed" configuration makes replacing the elastic piece cumbersome and sometimes even impossible. Some of the earlier knee ascenders have the elastic piece secured close to the cam bearing member. The amount of stretch that can be provided by the elastic piece in this configuration is limited due to the limited overall length of the elastic piece. Some of the more recent knee ascenders shifted the attachment point of the elastic piece closer to the foot attachment, thus increasing the overall length, and consequently overall stretching power of the elastic piece. These more recent knee ascenders however still adopted the "fixed" configuration where at least one end of the elastic piece is secured relative to the load bearing member, which imposes many inconveniences. For example, U.S. Pat. No. 9,352,190 by Frankhauser (hereinafter Frankhauser I) discloses a knee ascender assembly where at least a portion of an elastic cord having a fixed end and free end is embedded inside a load bearing member to provide greater length of stretch. The fixed end of elastic cord of Frankhauser I however is fixed relative to the load bearing member, making it difficult to replace.

U.S. Pat. No. 10,052,521 by Mumford (hereinafter Mumford) discloses a self-advancing knee ascender that does not have the elastic cord fixed relative to the load bearing member. Instead, the elastic cord folds over and forms a loop with two free ends held on the opposite end of the loop to form a double bungee configuration. The entire elastic cord of Mumford is slidable relative to the load bearing member, making replacement of the elastic cord easy to accomplish thus providing greater convenience to a user. Additionally, unlike any of the product on the market at the time, the load bearing member of Mumford has a stiff configuration, providing greater control of the orientation of the cam bearing member during an ascend. It should also be noted that because of the double bungee configuration, the elastic piece of the Mumford ascender has significantly increased stretching power compared to its counterpart in other known ascenders on the market. In general, it is widely known to the climbing community that Mumford ascender combines two radically innovative features, namely, a double bungee elastic piece with a stiff load bearing member and resulted in an ascender that is significantly superior to other contemporary devices.

U.S. Pat. No. 9,643,054 by Frankhauser (hereinafter Frankhauser II), with a priority filing date later than Mumford, discloses a radically altered design compared to Frankhauser I, with both ends of the elastic cord exposed, similar to Mumford. Also similar to Mumford, the entire elastic cord of Frankhauser II is slidable relative to the load bearing member and folded over. The folded over elastic cord of Frankhauser however, relies on an internally embedded pulley to facilitate the sliding of the elastic cord while maintaining the folded over configuration of the elastic cord. Despite the newly adopted folded over design, when the elastic cord of Frankhauser is pulled during an ascend, the pulling force is applied between the two ends of the elastic cord, providing the same stretching power as the original design in Frankhauser I. With the adoption of the two exposed ends and slidable design, the elastic cord of Frankhauser II is easier to replace compared to its original design in Frankhauser I, with the tradeoff of the added pully without improving the stretch power.

In general, the length of these existing knee ascenders is not easily adjustable, the components of these ascender are not modular for easy replacement, and the component that guides the elastic piece are not modular relative to the load bearing member. There therefore exists a need for a knee ascender that provides robust stretch and easy replacement and adjustment of its components.

SUMMARY

Provided herein is a modular self-advancing knee ascender with an elastic bearing member that is separate and removable from a load bearing member.

In a first aspect, provided herein is a self-advancing knee ascender having a load bearing member, a cam bearing member, an elastic bearing member and a foot attachment. The load bearing member has a non-stretchable connecting piece that comprises a first end and a second end. The cam bearing member is secured to the first end of the connecting piece of the load bearing member. The cam bearing member comprises a cam configured to engage a rope while weight is applied on the cam and to disengage the rope when the weight is relieved from the cam. The foot attachment is connected to the second end of the connecting piece of the load bearing member. The elastic bearing member is independent of the load bearing member and removably connected to at least the cam bearing member. The elastic bearing member generally comprises an elastic piece and a guiding piece guiding the elastic piece. In some embodiments, the non-stretchable connecting piece of the load bearing member comprises a piece of non-stretchable webbing connecting the cam bearing member and the foot attachment and the length of the non-stretchable connecting piece is optionally adjustable via an adjustment element. In some embodiments, the adjustment element is a buckle. In some embodiments, the elastic bearing member is further removably attached to the load bearing member via a non-permanent connection, e.g. a hook and loop connection. In some embodiments, the elastic piece has a first side and a second side, with the first side of the elastic piece retained by the guiding piece when the second side of the elastic piece is pulled. The guiding piece has a first end and a second end. In some embodiments, the elastic piece comprises a folded elastic cord in a double bungee configuration and the guiding piece guiding a portion of the folded elastic cord to form the double bungee configuration. In some embodiments, the folded elastic cord comprises two ends and the guiding piece comprises a first tube and a second tube that is parallel to the first tube, the first and second tubes each having a first end and a second end. The elastic cord is folded over and positioned inside the first and the second tubes such that two ends of the elastic cord extends beyond the first ends of the tubes while forming a loop between the second ends of the parallel tubes. The ends of the elastic cord collectively are considered the first side of the elastic piece and the loop is considered the second side of the elastic piece, forming the double bungee configuration with the elastic cord remaining slidable relative to the tubes. In some embodiments, the guiding piece is a stiff tether and together with the double bungee of the elastic cord forms a double bungee stiff tether elastic bearing member. In some embodiments, the cam bearing member comprises an engaging element configured to engage the second end of the guiding piece such that when the second side of the elastic piece is pulled, the elastic bearing member remains engaged with the cam bearing member. For example, the engaging element may be a protruding element that catches a notch of the second end of the guiding piece to engage the guiding piece. In some embodiment, the cam bearing member further comprises an attachment point for attaching a top elastic element.

In a second aspect, provided herein is a double bungee stiff tether self-advancing knee ascender having a load bearing member, a cam bearing member, a double bungee stiff tether elastic bearing member and a foot attachment. The load bearing member has a non-stretchable connecting piece that comprises a first end and a second end. The cam bearing member is secured to the first end of the connecting piece of the load bearing member. The cam bearing member comprises a cam configured to engage a rope while weight is applied on the cam and to disengage the rope when the weight is relieved from the cam. The foot attachment is connected to the second end of the connecting piece of the load bearing member. The double bungee stiff tether elastic bearing member is independent of the load bearing member and removably connected to at least the cam bearing member. The elastic bearing member comprises a double bungee elastic piece and a stiff tether guiding piece guiding the double bungee of the elastic piece. The double bungee elastic piece has a first side and a second side, with the first side of the double bungee elastic piece retained by the stiff tether guiding piece when the second side of the double bungee elastic piece is pulled. The stiff tether guiding piece has a first end and a second end. The non-stretchable connecting piece comprises a piece of non-stretchable webbing connecting the cam bearing member and the foot attachment. The cam bearing member comprises an engaging element configured to engage the second end of the stiff tether guiding piece such that when the second side of the double bungee elastic piece is pulled, the double bungee stiff tether elastic bearing member remains engaged with the cam bearing member. The double bungee comprises an elastic cord having two ends and the stiff tether guiding piece comprises a first stiff tube and a second stiff tube that is parallel to the first stiff tube, sandwiching a piece of webbing with the first and second tubes each having a first end and a second end. The elastic cord is folded over and positioned inside the first and the second tubes such that two ends of the elastic cord extends beyond the first ends of the tubes while forming a loop between the second ends of the parallel tubes, the ends of the elastic cord collectively are considered the first side of the elastic piece and the loop is considered the second side of the elastic piece, forming the double bungee configuration with the elastic cord remaining slidable relative to the tubes. The length of the non-stretchable connecting piece is optionally adjustable via a buckle. In some embodiments, the stiff guiding piece is further removably attached to the load bearing member via a hook and loop type of attachment and the engaging element of the cam bearing member is a protruding element that catches a notch of the second end of the stiff tether guiding piece. In some embodiments, the cam bearing member further comprises an attachment point for attaching a top elastic cord. In some embodiments, a method of using the double bungee stiff tether self-advancing knee ascender disclosed herein by a climber is disclosed. The method comprises the steps of attaching the foot attachment to a foot of the climber, attaching the second side of the double bungee elastic piece to a point above the cam bearing member; engaging the cam of the ascender on a rope; stepping on the foot attachment to fully extend the load bearing member to apply weight on the cam while at least partially extend the elastic piece, and lifting the foot along with the foot attachment to relax the load bearing member to allow the extended double bungee to pull the cam upward along the rope.

In a third aspect, provided herein is a method of using an ascender disclosed herein by a climber. The method comprises the steps of attaching the foot attachment to a foot of the climber, attaching the second side of the elastic piece to a point above the cam bearing member, engaging the cam of the ascender on a rope, stepping on the foot attachment to fully extend the load bearing member to apply weight on the cam to lock the cam in place while at least partially extend the elastic piece, and lifting the foot along with the foot attachment to relax the load bearing member and to unlock the cam to allow the extended elastic piece to pull the unlocked cam upward along the rope. In some embodiments, the cam bearing member further comprises an attachment point for attaching a top elastic piece and the method further comprises attaching the top elastic piece to a point above the cam bearing member such as the upper body of the climber, the stepping step further comprises at least partially extending the top elastic piece, and the lifting step further comprises to allow the extended top elastic piece to also pull the cam upward along the rope. In some embodiments, the cam bearing member further comprises an attachment point for attaching a top elastic piece and the method further comprises removing or disengaging the elastic bearing member from the cam bearing member, attaching the top elastic piece to a point above the cam bearing member such as the upper body of the climber, the stepping step comprises at least partially extending the top elastic piece, and the lifting step comprises to allow the extended top elastic piece to pull the cam upward along the rope. In some embodiments, the lifting step further comprises having the stiff tether pushing the cam bearing member upwards through the lifting of the foot in addition to the pulling force from the double bungee elastic piece to unlock the cam and lifting the ascender along the rope.

BRIEF DESCRIPTION OF THE DRAWINGS

The drawing figures are not necessarily to scale and certain features may be shown exaggerated in scale or in a somewhat generalized or schematic form in the interest of clarity and conciseness. For more complete understanding of the features and advantages of the present invention, reference is now made to the detailed description along with the accompanying figures, wherein.

DETAILED DESCRIPTION

Definitions

Figure 1:
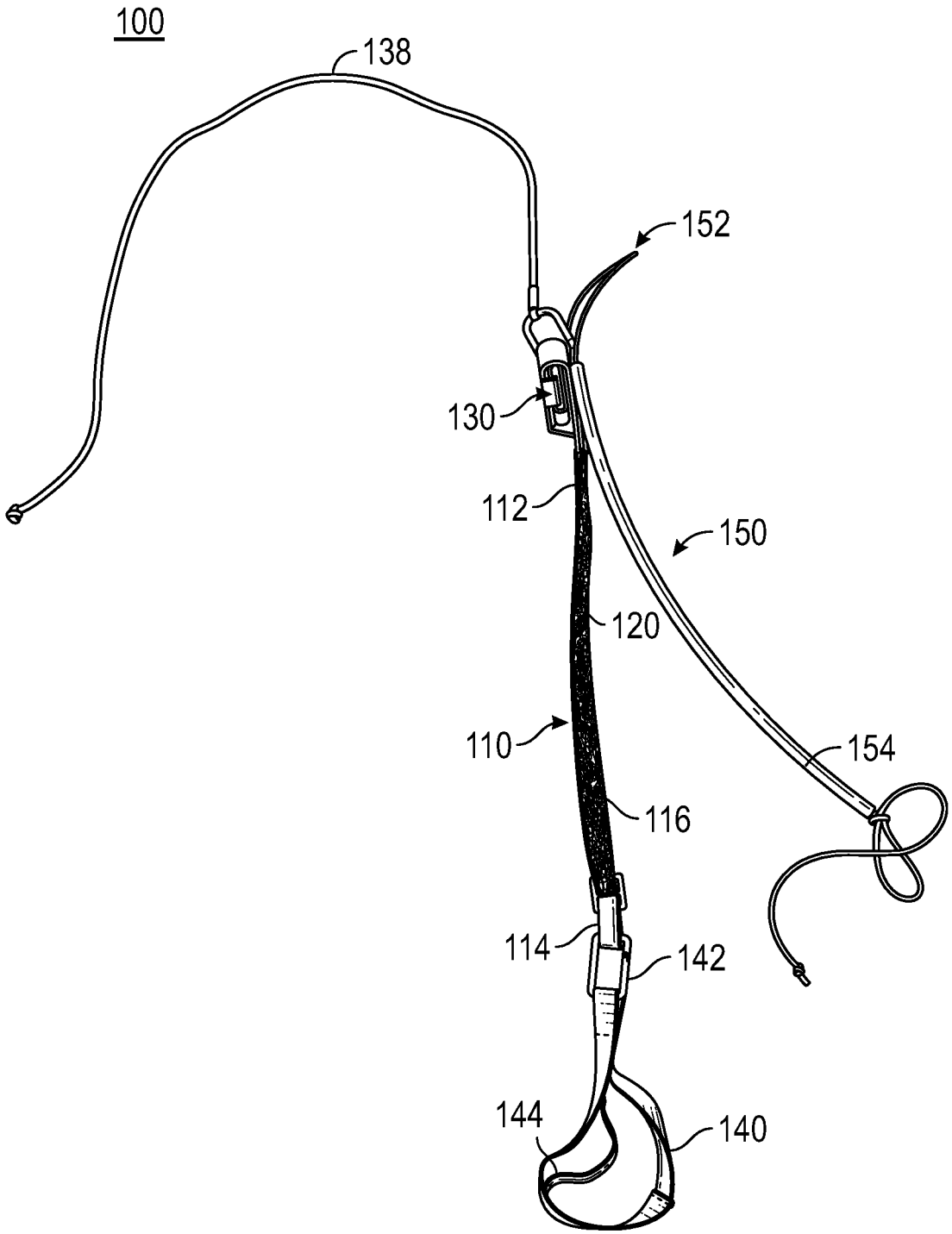
FIG. 1 is a side view of an ascender in an assembled configuration according to some embodiments of the invention.

The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a composition that "comprises," "has," "includes" or "contains" one or more elements possesses those one or more elements but is not limited to possessing only those elements. Likewise, a method that "comprises," "has," "includes" or "contains" one or more steps possesses those one or more steps but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon.

The present disclosure may be understood more readily by reference to the following detailed description of embodiments and to the Figures and their previous and following description.

The knee ascenders disclosed herein provides robust performance during an ascend. It has retained the advantages of the self-advancing knee ascender disclosed in Mumford discussed in the Background section above and provide significant additional benefit of being modular and adjustable. Because the elastic bearing member of the ascender is only removably attached to the load bearing member, it does not bear any weight during an ascend and provides additional versatility to fit climber's different needs.

Referring to FIG. 1, a side view of an embodiment of a self-advancing knee ascender 100 with a removable non load bearing tether disclosed herein is shown. The ascender 100 comprises a load bearing member 110 having a non-stretchable connecting piece 116 comprising a first end 112 and a second end 114; a cam bearing member 130 secured to the first end 112 of the connecting piece 116 of the load bearing member 110; a foot attachment 140 depending from the second end 114 of the connecting piece 116 of the load bearing member 110; and an elastic bearing member or tether 150 independent of the load bearing member 110 and removably connected to at least the cam bearing member 130. The elastic bearing member 150 is non-load bearing and is configured to provide rebound of the ascender during usage. The elastic bearing member 150 of the ascender 100 comprises an elastic piece 152 and a guiding piece 154 guiding the elastic piece 152. Because the elastic bearing member 150 is only removably connected to at least the cam bearing member 130, it is not secured to the cam bearing member 130 or other parts of the ascender and therefore does not bear any load from the climber and only rebounds the ascender and is easily removable. The foot attachment 140 may further comprise an elastic band 144 to help secure the food attachment around a climber's foot. The load bearing member 110 in general is made of material that will sufficiently bear the weight of the climber and has a length that spans a distance that is the average distance from the foot to the knee of a climber.

Figure 2A:
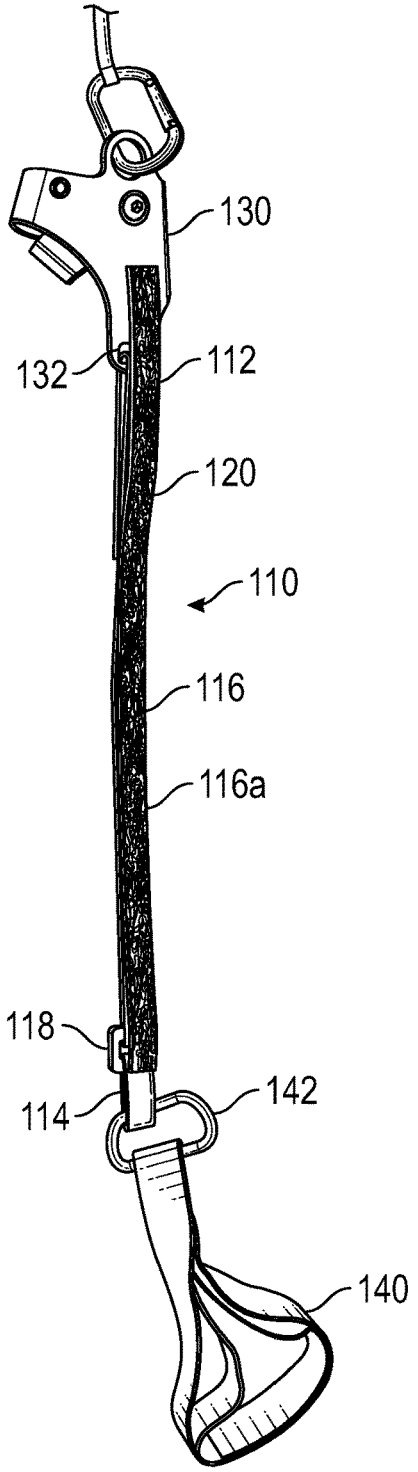
FIG. 2A is a front view of the ascender of FIG. 1 without the elastic bearing member, showing a non-permanent connection element.
Figure 2B:
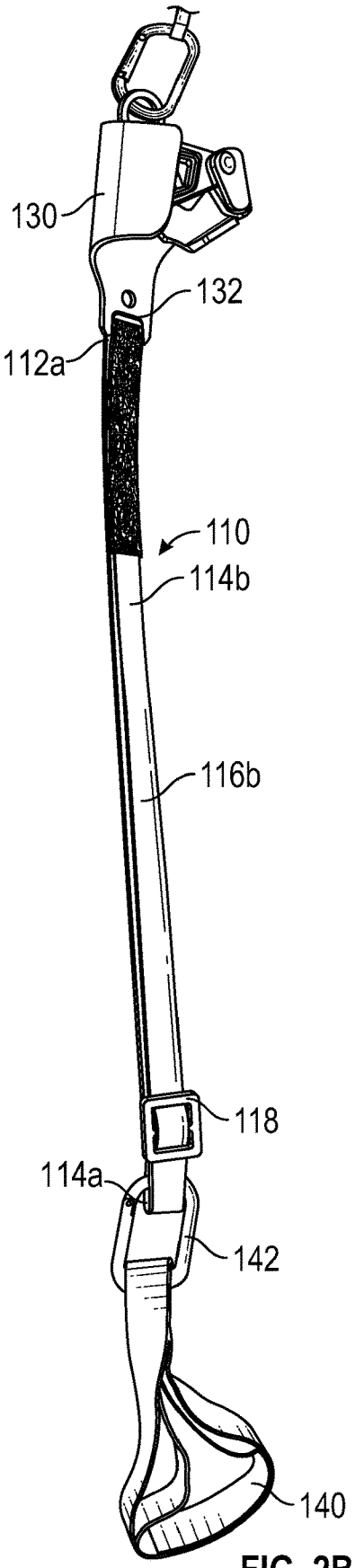
FIG. 2B is a back view of the ascender of FIG. 1 without the elastic bearing member.

The front and back views of the load bearing member 110 with the secured CAM bearing member 130 according to some embodiments of the disclosure are shown in FIGS. 2A and 2B, respectively. The non-stretchable connecting piece 116 can be a piece of non-stretchable webbing connecting the cam bearing member 130 and the foot attachment 140, with the front 116*a* and back 116*b* of the connecting piece 116 shown in FIGS. 2A and 2B, respectively.

In some embodiments, the length of the non-stretchable connecting piece 116 is adjustable via an adjustment element such as a buckle 118 shown in FIGS. 2A and 2B. The buckle 118 may be made of load bearing material such that it maintains its integrity and mechanical function when the load bearing member 110 bears the weight of a climber. Consequently, the length of the load bearing member 110 can be adjusted to different lengths to suite various needs such as the height of the climber, climber's preferred location of the cam bearing element during his or her rope ascend, and the desired length of stride at any given moment of the climber. For example, similar to running has a longer stride than walking, ascending on a rope quickly may require a longer stride than when climbing at a more leisure or comfortable speed. The advantage of a variable length load bearing member is the climber can easily adjust the length of the load bearing member to suite his or her needs. In some embodiments, the non-stretchable connecting piece 116 can be significantly shortened to suite a minor. In some embodiments, once the non-stretchable connecting piece 116 is significantly shortened, it may become shorter than the elastic bearing member 150. Although the portion of the elastic bearing member 150 that is not attached to the non-stretchable connecting piece 116 will protrude beyond the foot of the climber, it will not interfere with the usage of the ascender during the climber's ascend. Alternatively, the elastic bearing member 150 can be shortened by cutting off a portion of the guiding piece 154 to match the shorten non-stretchable connecting piece 116.

The load bearing member 110 may further comprise a non-permanent connection element such as a hook and loop connection element 120 shown in FIG. 1 and FIG. 2A, attached to the front 116*a* of the connecting piece 116. In some embodiments such as shown in FIG. 2A, the connection element 120 may optionally extend beyond the load bearing member 110 and onto the cam bearing member 130. In some embodiments as shown in FIG. 2A, part of the connection element 120 is sewn onto the load bearing member 110 and the other part of the connection element 120 is glued onto the cam bearing member 130. In some embodiments, the connection element may be glued onto the load bearing member as well as the cam bearing member. Additionally, the connection element can be attached onto the cam bearing member via bolting. Combination of two or more ways of attachment such as bolting, gluing, and sewing can also be used to attach the connection element onto the load bearing member and optionally additionally cam bearing member. The non-permanent connection element is not required for the function of the device but can be helpful to maintain the orientation of the ascender during usage by forming connection between the load bearing member 110 and the elastic bearing member 150. In some embodiments, the first end 112 of the connecting piece 116 loops through an opening 132 of the cam bearing member 130 to form a first loop 112*a* and the second end 114 of the connecting piece 116 goes through the buckle 118 to form a second loop 114*a* for attachment of the foot attachment 140 and extends beyond the buckle 118 to form a tab 114*b*. A hook and eye type of attachment can be additionally attached onto the tab portion of the connecting piece. The length of the tab 114*b* may vary dependent upon the adjustment of the length of connecting piece. To catch the tab 114*b* and prevent it from slouching downward, a matching hook and eye type of attachment maybe attached to the connecting piece 116, close to the first end 112 such that the tab 114*b* can be secured through attaching its hook and eye type of attachment onto the matching hook and eye type of attachment on the connecting piece. One or more ways of attachment such as bolting, gluing, and sewing can also be used to attach the hook and eye type of attachments onto the load bearing member. In some embodiment, the first end 112 of the connecting piece 116 is sewn onto the connection piece 116 to form the first loop 112*a*. Because the second end 114 can be easily disassembled from the buckle 118 and the first end 112 can be easily removed from the opening 132, the connecting piece 116 can be relatively easily replaced. The second loop 114*a* of the second end 114 of the connecting piece 116 can be connected to the foot attachment 140 via a connector 142 such that the cam bearing member 130, the load bearing member 110, and the foot attachment 140 are modular relative to each other and can be switched out for replacement. In some embodiment, the connector 142 is a carabiner as shown in FIG. 2B. In some embodiments, the non-stretchable connecting piece 116 can be a piece of non-stretchable webbing as shown in the figures disclosed herein. Alternatively, the non-stretchable connecting piece can be a rope, a chain, a spliced adjustable cordage, or alike.

Figure 3A:
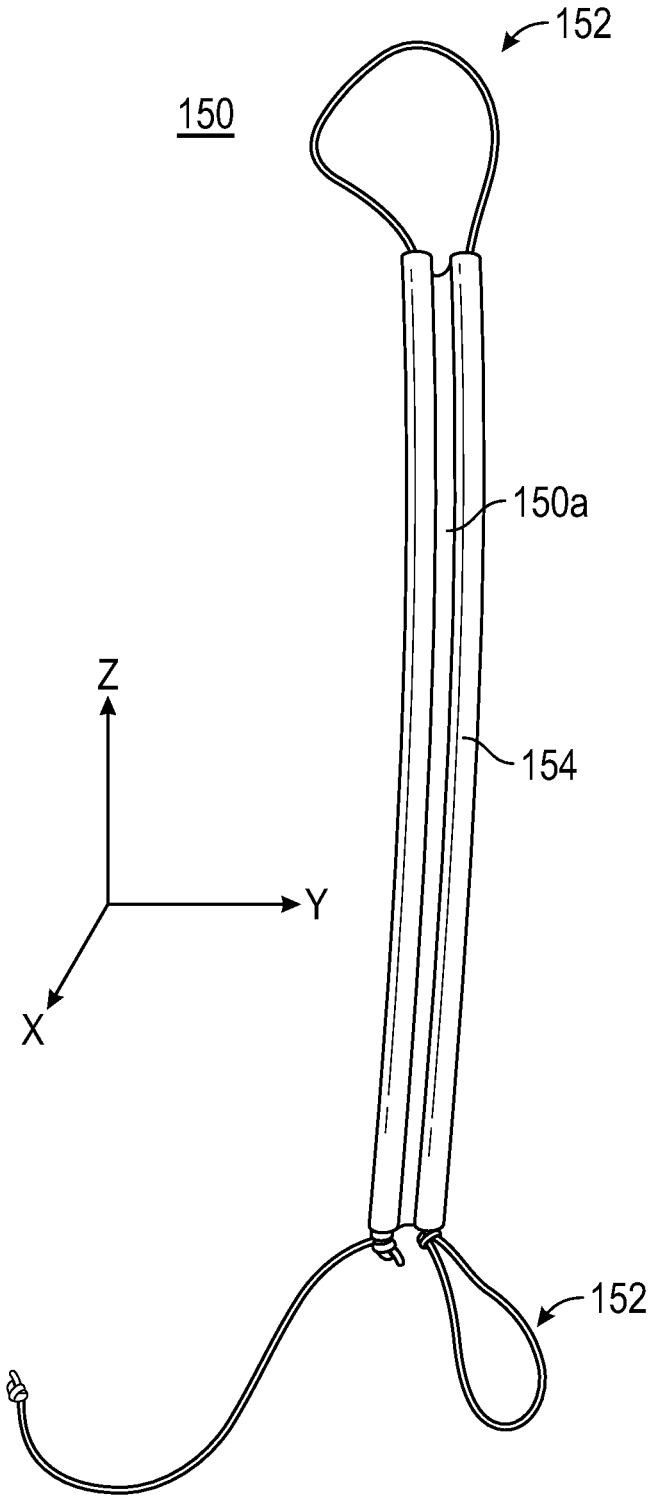
FIG. 3A is a front view of the elastic bearing member of the ascender of FIG. 1.
Figure 3B:
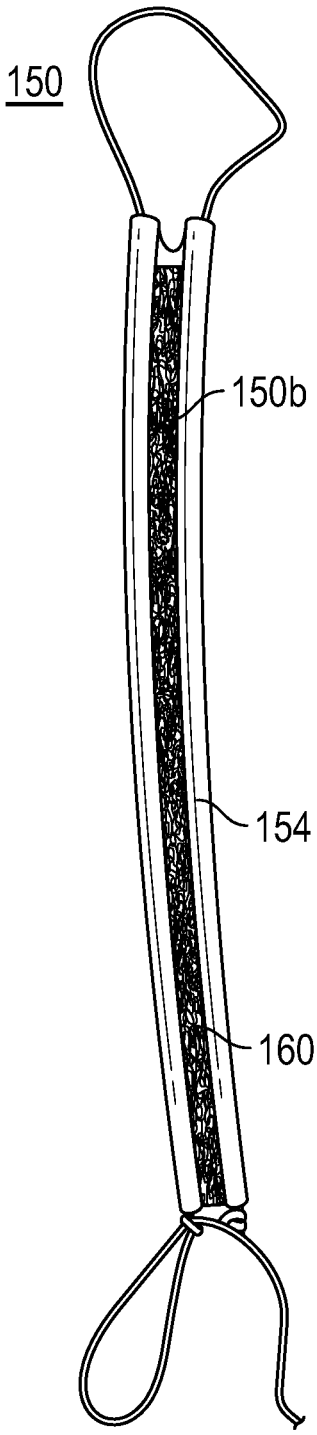
FIG. 3B is a back view of the elastic bearing member of the ascender of FIG. 1, showing a non-permanent connection element.

The front side 150*a* and back side 150*b* of the elastic bearing member 150 according to some embodiments of the disclosure are shown in FIGS. 3A and 3B, respectively. At least on the back side 150*b* of the elastic bearing member 150, a non-permanent connection element such as a hook and loop connection element 160 as shown in FIG. 1 and FIG. 3B, is attached to the back side 150*b* of the elastic bearing member 150. In some embodiments, the non-permanent connection element may be present on both sides of the guide member 150. The non-permanent connection element attached to the front side 150*a* and the backside 150*b* may be made of the same or different materials and have the same or different designs. Although a hook and loop type of non-permanent connection is used in the examples, it is understood that any non-permanent connection that does not interfere with the normal function of the ascender can be used instead of or in addition to the hook and loop type of connection. For example, the load bearing member 110 may comprise tabs that can be used to tie up the non-load bearing elastic bearing member 150. Alternatively, the non-load bearing elastic bearing member 150 may comprise tabs that can be used to tie to the load bearing member 110. In some embodiments, the load bearing member 110 and the non-load bearing member 150 can each have tabs for tie up to each other to help maintain the upright orientation of the ascender during a typical ascend.

Figure 4A:
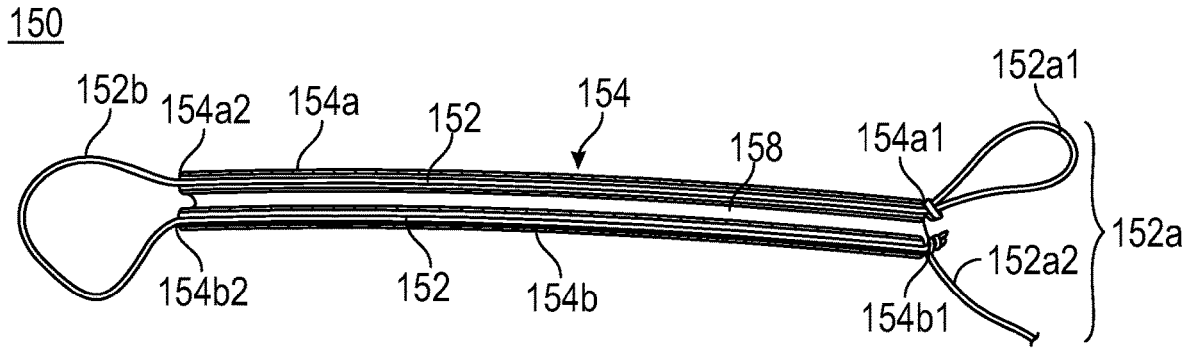
FIG. 4A is a cross-sectional view of the elastic bearing member of FIG. 3A along the ZY plane showing the elastic piece guided by the guiding piece, forming a double bungee inside a stiff tether.

The elastic piece in general has a first side and a second side, with the first side retained by the guiding piece 154 when the second side is pulled. In some embodiments, the elastic piece comprises an elastic cord and the guiding piece comprises a tube guiding a portion of the elastic cord. For example, FIG. 4A is a cross sectional view of elastic bearing member 150 of FIG. 3A long the ZY plane, showing a double bungee stiff tether elastic bearing member 150 according to some embodiments of the present disclosure. Specifically, the elastic cord 152 folds over as a double bungee and has two ends 152*a*1, 152*a*2 forming first side 152*a* and loop 152*b* forming second side. The guiding piece 154 comprises a first tube 154*a* and a second tube 154*b* that is parallel to the first tube 154*a*. The tubes 154*a* and 154*b* are optionally spaced part by a webbing section 158. The first and second tubes 154*a* and 154*b* each having a first end 154*a*1, 154*b*1 and a second end 154*a*2, 154*b*2, respectively. The folded over elastic cord 152 is positioned inside the first and the second tubes 154*a*, 154*b* such that two ends 152*a*1, 152*a*2 of the elastic cord 152 extend beyond the first ends 154*a*1 and 154*b*1 of the tubes 154*a*, 154*b* while forming a bungee loop 152*b* between the second ends 154*a*2 and 154*b*2 of the parallel tubes 154*a* and 154*b*, forming a double bungee configuration. A carabiner maybe used to connect the bungee loop 152*b* to an attachment point above the cam bearing member 130 during an ascend.

Figure 4B:
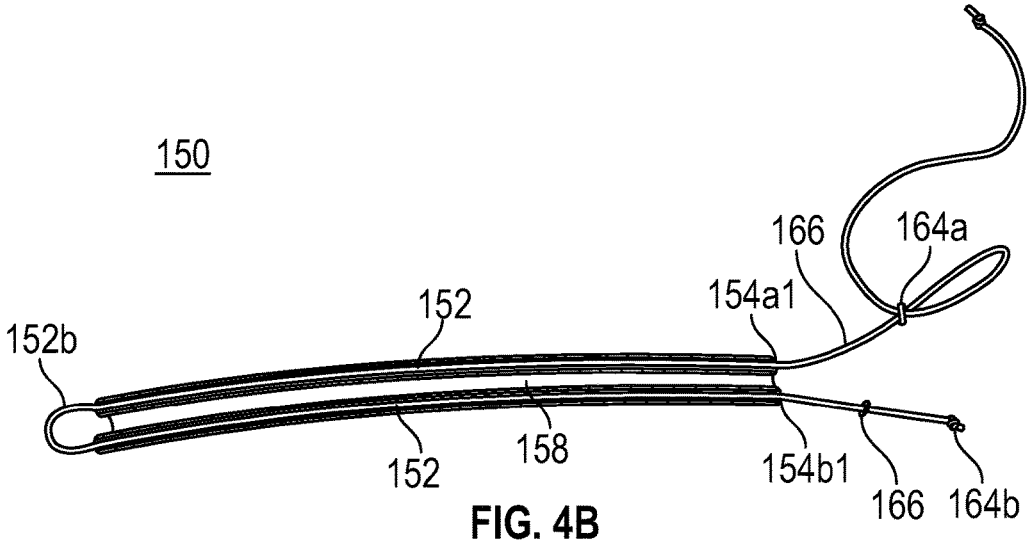
FIG. 4B is a cross-sectional view of the guiding member of FIG. 4A with the ends of the elastic cord extended beyond the guiding piece.

The ends 152*a*1, 152*a*2 are optionally knotted and collectively is considered the first side 152*a* of the elastic piece 152. The loop 152*b* is considered the second side of the elastic piece 152. The ends 152*a*1, 152*a*2 may additionally have washers 166 to help retain the knots 164*a* and 164*b* from entering the tubes 154*a*, 154*b* when the double bungee is pulled from the loop 152*b*. Although the first side 152*a* of the elastic piece 152 retains the guiding piece 154 when the second side 152*b* is pulled because of the knots 164*a*, 164*b*, the entire elastic cord 152 otherwise remains slidable inside the tubes 154*a* and 154*b* such that the positions of the ends 152*a*1 and 152*a*2 are not secured relative to the guiding piece 154. FIG. 4B is another view of the elastic bearing member 150 having the ends 152*a*1, 152*a*2 extended beyond the first ends 154*a*1 and 154*b*1 of the tubes 154*a*, 154*b*, showing the knots 164*a*,164*b* and washers 166, and the significantly shortened loop 152*b*. Because the elastic cord 152 is not secured relative to the guiding piece 154, the length of the elastic piece can be easily adjusted to suit climber's needs. In the configuration shown in FIG. 4B, one of the knots is a dead knot 164*b* and the other knot is a slipper knot 164*a*, to allow easy adjustment of the length of the bungee. The elastic piece 152 can also be easily switched out for replacement without cumbersome disengagement from the guiding piece 154. In some embodiments, the second side 152*b* of the elastic piece 152 can be connected to a carabiner for easy attachment onto a point of the climber that is higher than the cam bearing member 130 during an ascend.

Figure 4C:
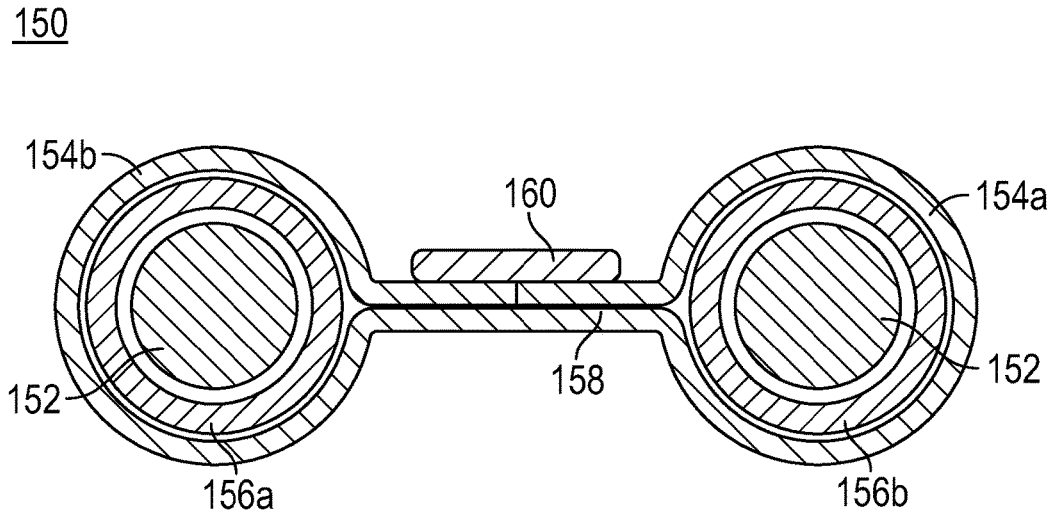
FIG. 4C is a cross-sectional view of the elastic bearing member of FIG. 3A along the XY plane showing the elastic cord encased by the tubes of the guiding piece.

FIG. 4C is a cross sectional view of elastic bearing member 150 of FIG. 3A along the XY plane. In FIG. 4C, the bungee 152 is shown to be surrounded by tubes 154*a* and 154*b*. The tubes 154*a* and 154*b* are parallel to each other and optionally spaced part by a webbing section 158. The non-permanent connection element 160 is shown to be attached to the webbing section 158. In some embodiments, the width of the webbing section 158 is wider than or the same as the width of the non-stretchable connecting piece 116 to allow adequate contact between the non-permanent connection element 120 of the load bearing member 110 and the non-permanent connection element 160 of the elastic bearing member 150. In some embodiments, the tubes 154*a*, 154*b* and the webbing section 158 are made from a single piece of webbing through sewing and gluing. In some embodiments, the tubes 154*a* and 154*b* further comprising a bolster tube 156*a*, 156*b* respectively inside the tubes 154*a*, 154*b* and surrounding the elastic cord 152. In some embodiment, the bolster tubes 156*a* and 156*b* are made from plastic. Although webbing is used in the example of FIG. 4C to construct the elastic bearing member 150, it is understood that the elastic bearing member 150 can be made of other materials as long as the configuration of the elastic bearing member 150 described above is maintained. For example, the tubes 154*a*, 154*b* and the webbing section 158 can be constructed from extruded rubber or plastic. The rubber or plastic elastic bearing member may or may not have the bolster tubes 156*a* and 156*b*.

In some embodiments, the guiding piece 154 is a stiff tether and together with the double bungee of the elastic piece 152 forms a double bungee stiff tether elastic bearing member 150. Although tubes are shown in figures as part of the guiding piece that encase the elastic cord, other guiding mechanism could be used to achieve the same function. For example, instead of having two parallel continuous tubes to guide the elastic piece, each tube could have gaps in them, exposing part of the elastic cord. For another example, the double bungee can be guided by intermittent tabs to maintain the double bungee configuration.

Figure 5A:
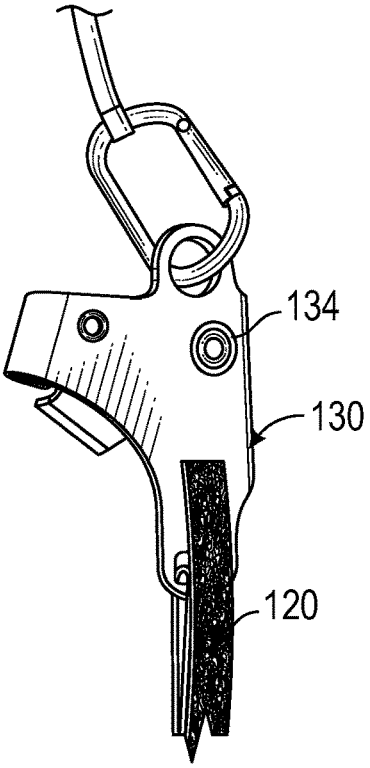
FIG. 5A is an enlarged view of the cam bearing member of FIG. 1 without the guiding piece.
Figure 5B:
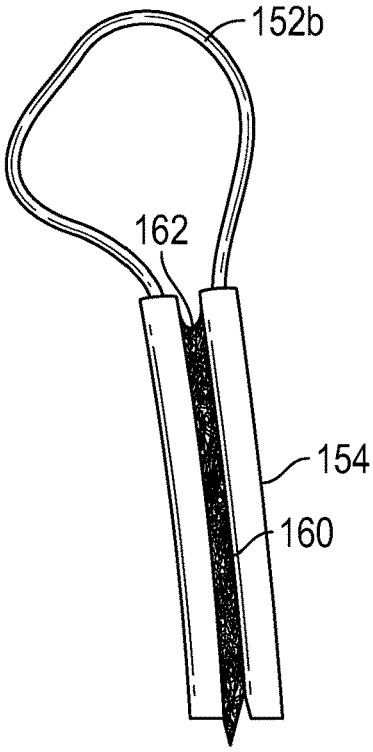
FIG. 5B is an enlarged view of one end of the guiding piece showing a notch.
Figure 5C:
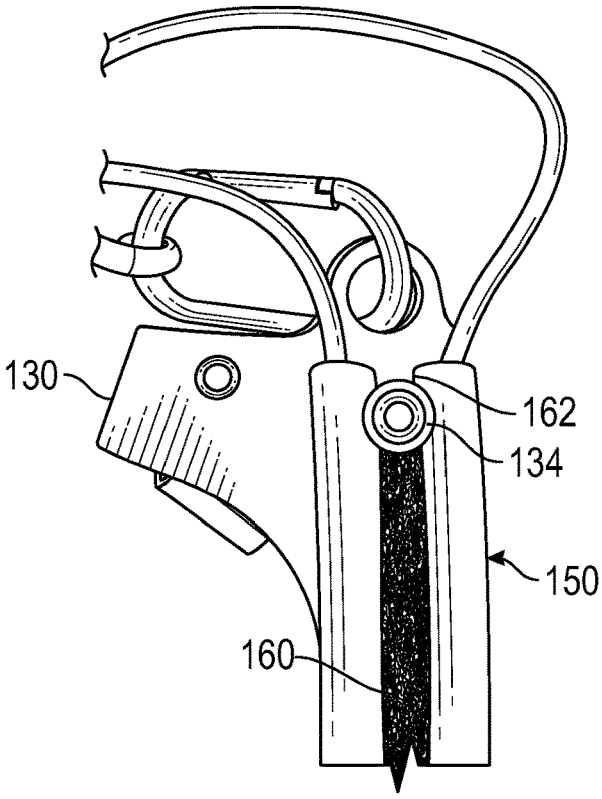
FIG. 5C is an enlarged view of the cam bearing member of FIG. 5A removably attached to the guiding piece of FIG. 5B.

To allow the attachment of elastic bearing member 150, the cam bearing member 130 comprises an engaging element such as a protruding element 134 configured to engage one end of the guiding piece 154, for example by catching a notch or open slot 162 of the guiding piece 150, as shown in FIG. 5C, such that when the second side 152*b* of the elastic piece 152 is pulled, the elastic bearing member 150 remains connected to the cam bearing member 130 as shown in FIG. 1 and FIG. 5C. FIG. 5A shows the protruding element 134 of the cam bearing member 130 when the elastic bearing member 150 is detached. FIG. 5B shows the end of the elastic bearing member 150 having the notch 162. The notch and protruding element engagement described above is configured to hold the elastic bearing member 150 in place without bearing any load of the climber.

During usage, the foot attachment generally is attached to a foot of the climber and the second side of the elastic piece normally is attached to a point above the cam bearing member such that when the climber steps into the foot attachment to shift his or her weight to the foot to fully extend his leg on the rope, the elastic piece is at least partially extended, creating a tension. Once the climber shifts his or her weight to the other foot and lift the foot, the tension of the elastic piece pulls the cam bearing member upward. The second side of the elastic piece can be attached for example to a chest piece or a saddle of the climber, or any position above the cam bearing member 130. The amount of the tension created by the extension of the elastic piece, can be adjusted by moving the attachment point of the second side of the elastic piece higher or lower on the climber's body to increase or decrease the tension created by the elastic piece. Alternatively, or additionally, the length of the elastic piece can be increased or decreased to decrease or increase the tension created as well. It should be noted that because the elastic piece is not secured relative to the guiding piece of the ascender disclosed herein and therefore can be easily removed and put back, in addition to adjustable elastic piece, the length of the guiding piece can be adjusted independently from the elastic piece. For example, the climber can cut off a portion of the guiding piece to make it shorter to match a shortened load bearing member if a shorter ascender is desired so that the ascender would fit a shorter climber better. Additionally, either the elastic piece or the guiding piece can be replaced independently of each other, thus creating total adjustability.

During ascend, the climber engages the cam bearing member onto a rope. By stepping onto the foot attachment of the ascender to initiate a climbing stride, the load bearing member is fully extended and bears the weight of the climber such that the cam is locked onto the rope while the elastic piece is at least partially extended. In the meantime, the body of the climber is pushed upward by the climbing stride. To advance the ascender upward, the climber could shift the weight to the other foot to relax the load bearing member to allow the cam to unlock. The unlocked cam together with the rest of the ascender can then be automatically pulled upward along the rope by the extended elastic piece in preparation for the next climbing stride.

The double bungee stiff tether ascender disclosed herein has the advantage of providing stronger pulling force provided by the double bungee to help the advancement of the ascender during ascend. Additionally, the relative mechanical coherence forged between the cam bearing member and the stiff tether guiding piece during the ascend helps to orient the cam bearing member, which being relatively heavier than the load bearing member, can cause the load bearing member to twist and orient unfavorably, which the stiff tether now effectively helps to eliminate. Furthermore, because the coherent configuration between the cam bearing member 130 and the stiff tether guiding piece 154, when the climber lifts the foot to relieve tension from the load bearing member 110, the stiff tether guiding piece 154 may also push the cam bearing member 130 upward. Consequently, the ascender disclosed herein provides more robust performance for a climber during an ascend.

Figure 6A:
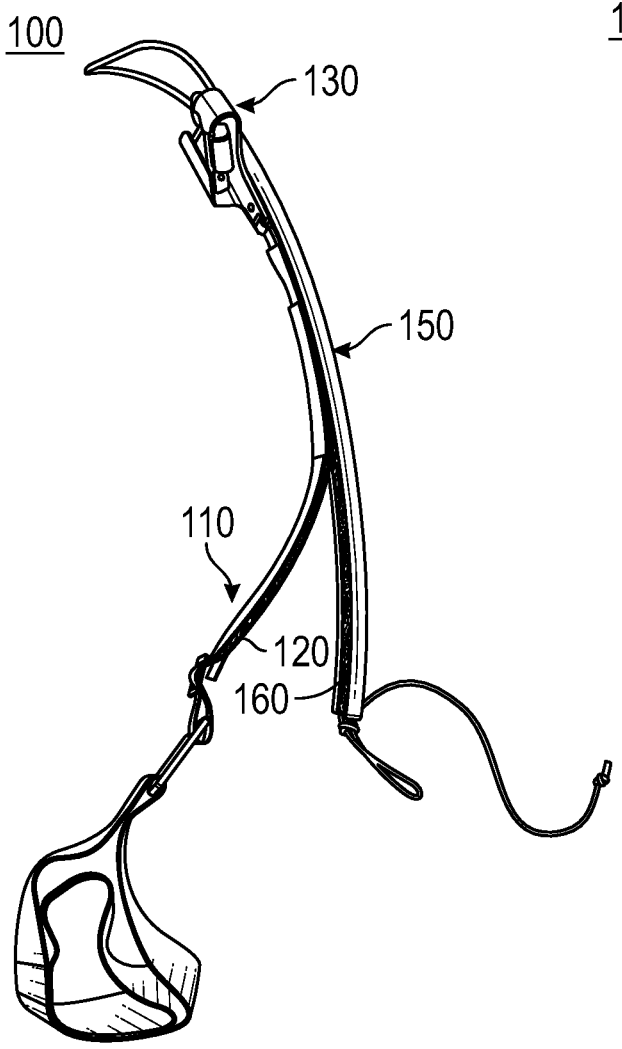
FIG. 6A is a side view of the ascender of FIG. 1 showing the elastic bearing member mating with the load bearing member to form an assembled ascender according to some embodiments of the disclosure.

Referring to FIG. 6A, a side view of ascender 100 assembled in one configuration is shown, where in addition to the engagement between the cam bearing member 130 and the elastic bearing member 150, the non-permanent connection element 120 of the load bearing member 110 is mating with the non-permanent connection element 160 of the elastic bearing member 150 to form a removable connection between the load bearing member 110 and the elastic bearing member 150.

Figure 6B:
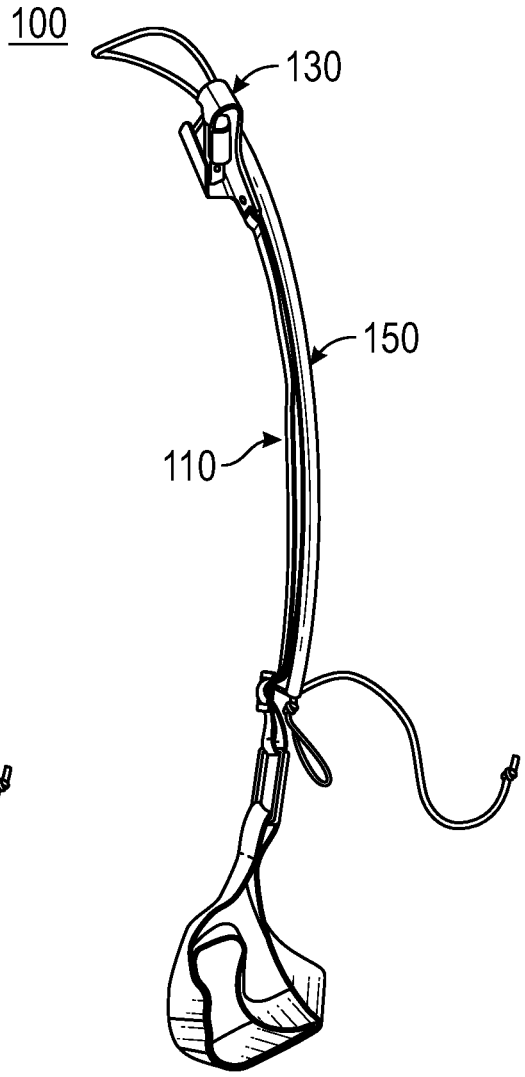
FIG. 6B is a side view of the ascender of FIG. 6A showing the assembled ascender after the mating is complete.

Referring to FIG. 6B, a front view of assembled ascender 100 from FIG. 6A is shown, where the load bearing member 110, the cam bearing member 130, and the elastic bearing member 150 are shown to be removably connected or attached to each other.

Figure 7A:
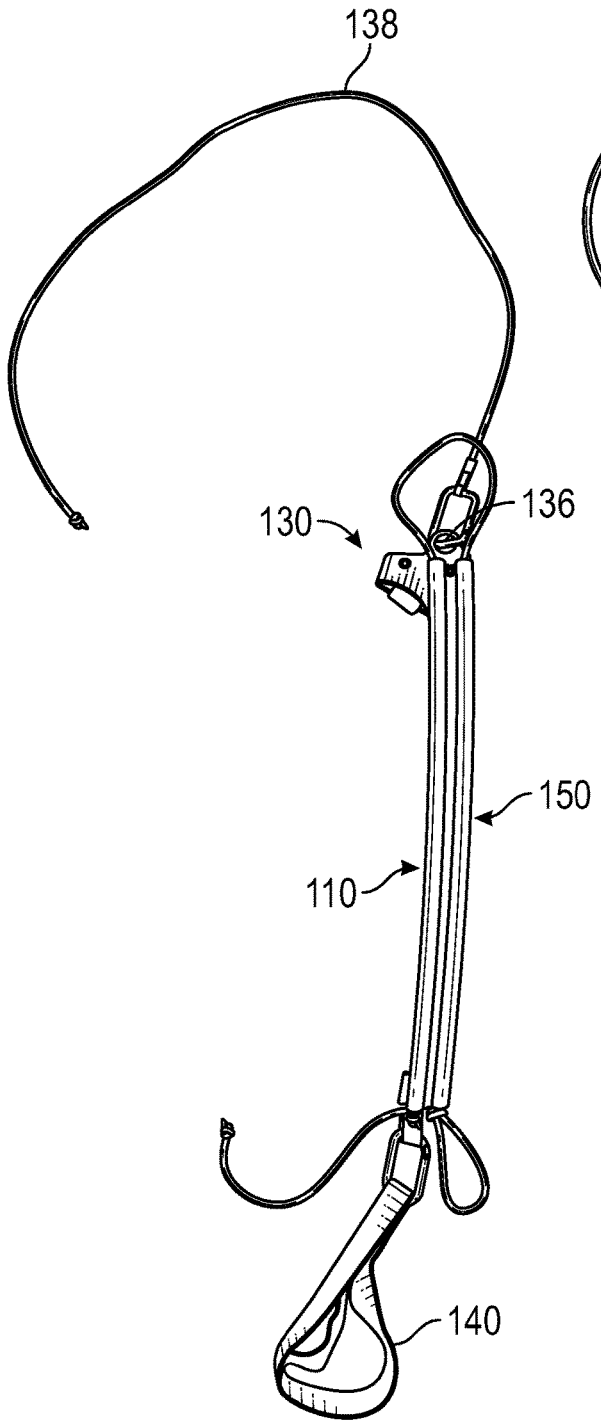
FIG. 7A is a front view of an ascender in another assembled configuration according to some embodiments of the invention having a top elastic element.

In some embodiments, the cam bearing member 130 further comprises an attachment point 136 for removably attaching a top elastic element 138 as shown in FIG. 7A. The cam bearing member 130, the load bearing member 110, the foot attachment 140, and the top elastic element 138 are modular relative to each other and can be switched out for replacement. During usage, in addition to the second side 152*b* of the elastic piece 152, the top elastic piece 138 can also be attached to upper body of the climber. The top elastic piece 138 thus provides tension that is in addition to the tension provided by the elastic piece 152, making the overall tension stronger than if just the elastic piece 152 is used. The top elastic element 138 is removably attached or connected to the load bearing member or the cam bearing member and thus can be easily replaced. It should be noted that in general, the top elastic element 138 needs to be attached higher on the climber compared to the elastic piece 152 because the stretchable section of the top elastic piece runs higher compared to the elastic piece 152. In some embodiments, the top elastic element 138 is attached to the chest level of the climber. The second side 152*b* of the elastic piece 152 can be attached for example to a chest harness or attachment at chest level, to a waist harness such as a saddle or attachment at waist level, or anywhere as long as it is above the cam bearing member 130 during an ascend.

Figure 7B:
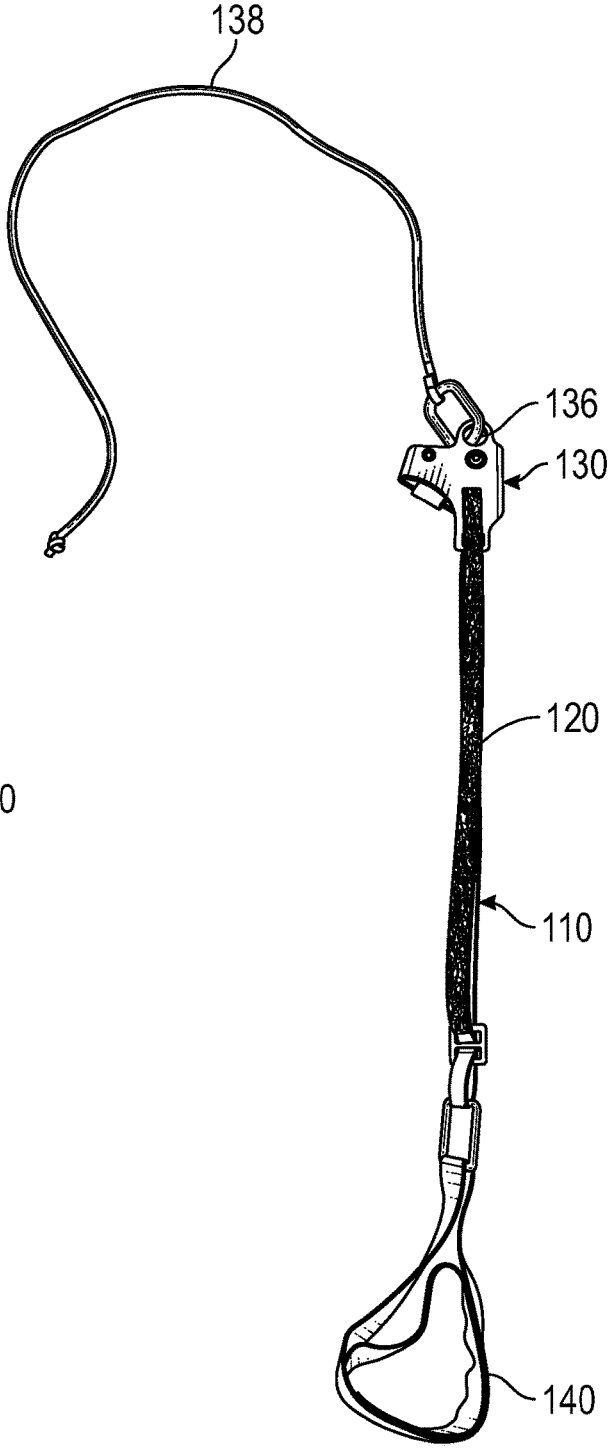
FIG. 7B is a front view of the ascender of FIG. 7A with the elastic bearing member removed, showing a more compact configuration of the ascender.

While the ascender 100 disclosed herein are often used when fully assembled, during situation where a smaller profile ascender is desired, the guiding piece 154 can be removed entirely from the ascender 100, as shown in FIG. 7B. Because the load bearing member 110 and the foot attachment 140 can both be made out of flexible material, the top elastic element 138, the load bearing member 110, and the foot attachment 140 can be wound around the cam bearing member 130 to achieve a reduced profile. During usage, the elastic pulling force is then supplied by the top elastic element 138 only.

The embodiments above are intended to be illustrative and not limiting. Additional embodiments are within the claims. In addition, although the present disclosure has been described with reference to particular embodiments, those skilled in the art will recognize that changes can be made in form and detail without departing from the spirit and scope of the disclosure. Any incorporation by reference of documents above is limited such that no subject matter is incorporated that is contrary to the explicit disclosure herein.

I claim:

1. A self-advancing knee ascender, comprising, a load bearing member having a non-stretchable connecting piece that comprises a first end and a second end;

a cam bearing member secured to the first end of the connecting piece of the load bearing member, wherein the cam bearing member comprising a cam configured to engage a rope while weight is applied on the cam and to disengage the rope when the weight is relieved from the cam;

a foot attachment connected to the second end of the connecting piece of the load bearing member; and an elastic bearing member comprising an elastic piece and a guiding piece guiding the elastic piece, wherein the elastic bearing member is independent from the load bearing member, and the guiding piece of the elastic bearing member is removably connected to the cam bearing member.

2. The ascender of claim 1, wherein the non-stretchable connecting piece comprises a piece of non-stretchable webbing connecting the cam bearing member and the foot attachment and the length of the non-stretchable connecting piece is adjustable via an adjustment element.

3. The ascender of claim 2, wherein the adjustment element is a buckle.

4. The ascender of claim 1, wherein the guiding piece of the elastic bearing member is further removably attached to the load bearing member via a non-permanent connection.

5. The ascender of claim 4, wherein the non-permanent connection is a hook and loop connection.

6. The ascender of claim 1, wherein the elastic piece having a first side and a second side, with the first side of the elastic piece retained by the guiding piece when the second side of the elastic piece is pulled.

7. The ascender of claim 6, wherein the elastic piece comprises an elastic cord and the guiding piece comprises a tube guiding a portion of the elastic cord.

8. The ascender of claim 6, wherein the elastic piece comprises an elastic cord has two ends and the guiding piece comprises a first tube and a second tube that is parallel to the first tube, the first and second tubes each having a first end and a second end, wherein the elastic cord is folded over and positioned inside the first and the second tubes such that two ends of the elastic cord extends beyond the first ends of the tubes while forming a loop between the second ends of the parallel tubes, and wherein the ends of the elastic cord collectively are considered the first side of the elastic piece and the loop is considered the second side of the elastic piece, forming a double bungee configuration with the elastic cord remaining slidable relative to the tubes.

9. The ascender of claim 8, wherein the guiding piece is a stiff tether and together with the double bungee of the elastic cord forms a double bungee stiff tether elastic bearing member.

10. The ascender of claim 6, wherein the guiding piece comprises a first end and a second end and the cam bearing member comprises an engaging element configured to engage the second end of the guiding piece such that when the second side of the elastic piece is pulled, the elastic bearing member remains engaged with the cam bearing member.

11. The ascender of claim 10, wherein the engaging element is a protruding element that catches a notch of the second end of the guiding piece to engage the guiding piece.

12. The ascender of claim 1, wherein the cam bearing member further comprises an attachment point for attaching a top elastic element.

13. A double bungee stiff tether self-advancing knee ascender, comprising, a load bearing member having a non-stretchable connecting piece that comprises a first end and a second end;

a cam bearing member secured to the first end of the connecting piece of the load bearing member, wherein the cam bearing member comprising a cam configured to engage a rope while weight is applied on the cam and to disengage the rope when the weight is relieved from the cam;

a foot attachment connected to the second end of the connecting piece of the load bearing member; and a double bungee stiff tether elastic bearing member independent of the load bearing member and removably connected to at least the cam bearing member, wherein the elastic bearing member comprises a double bungee elastic piece and a stiff tether guiding piece guiding the double bungee of the elastic piece, the double bungee elastic piece having a first side and a second side, with the first side of the double bungee elastic piece retained by the stiff tether guiding piece when the second side of the double bungee elastic piece is pulled, wherein the non-stretchable connecting piece comprises a piece of nonstretchable webbing connecting the cam bearing member and the foot attachment, wherein the guiding piece comprises a first end and a second end and the cam bearing member comprises an engaging element configured to engage the second end of the stiff tether guiding piece such that when the second side of the double bungee elastic piece is pulled, the double bungee stiff tether elastic bearing member remains engaged with the cam bearing member, wherein the double bungee comprises an elastic cord having two ends and the stiff tether guiding piece comprises a first stiff tube and a second stiff tube that is parallel to the first stiff tube, sandwiching a piece of webbing, the first and second tubes each having a first end and a second end, wherein the elastic cord is folded over and positioned inside the first and the second tubes such that two ends of the elastic cord extends beyond the first ends of the tubes while forming a loop between the second ends of the parallel tubes, the ends of the elastic cord collectively are considered the first side of the elastic piece and the loop is considered the second side of the elastic piece, forming the double bungee configuration with the elastic cord remaining slidable relative to the tubes, and wherein the length of the non-stretchable connecting piece is optionally adjustable via a buckle.

14. The ascender of claim 13, wherein the stiff guiding piece is further removably connected to the load bearing member via a hook and loop type of attachment and the engaging element of the cam bearing member is a protruding element that catches a notch of the second end of the stiff tether guiding piece.

15. The ascender of claim 13, wherein the cam bearing member further comprises an attachment point for attaching a top elastic element.

16. A method of using the ascender of claim 13 by a climber, the method comprising, attaching the foot attachment to a foot of the climber;

attaching the second side of the double bungee elastic piece to a point above the cam bearing member;

attaching the cam bearing member of the ascender onto a rope;

stepping on the foot attachment to fully extend the load bearing member to apply weight on the cam while at least partially extend the elastic piece; and lifting the foot along with the foot attachment to relax the load bearing member to allow the extended double bungee elastic piece to pull the cam upward along the rope.

17. A method of using an ascender by a climber, the ascender comprising, a load bearing member having a non-stretchable connecting piece that comprises a first end and a second end;

a cam bearing member secured to the first end of the connecting piece of the load bearing member, wherein the cam bearing member comprising a cam configured to engage a rope while weight is applied on the cam and to disengage the rope when the weight is relieved from the cam;

a foot attachment connected to the second end of the connecting piece of the load bearing member; and an elastic bearing member independent of the load bearing member and removably connected to at least the cam bearing member, wherein the elastic bearing member comprises an elastic piece and a guiding piece guiding the elastic piece, wherein the elastic piece comprises a first side and a second side, the method comprising, attaching the foot attachment to a foot of the climber;

attaching the second side of the elastic piece to a point above the cam bearing member;

attaching the cam bearing member of the ascender onto a rope;

stepping on the foot attachment to fully extend the load bearing member to apply weight on the cam to lock the cam in place while at least partially extend the elastic piece; and lifting the foot along with the foot attachment to relax the load bearing member and to unlock the cam to allow the extended elastic piece to pull the unlocked cam upward along the rope.

18. The method of claim 17, wherein the cam bearing member further comprises an attachment point for attaching a top elastic element and the method further comprising, attaching the top elastic element to the cam bearing member through the attachment point, attaching the top elastic element to upper body of the climber, the stepping step further comprising at least partially extending the top elastic element, and the lifting step further comprising to allow the extended top elastic element also to pull the cam upward along the rope.

19. The method of claim 17, wherein the cam bearing member further comprises an attachment point for attaching a top elastic element and the method further comprising, removing the elastic bearing member, attaching the top elastic element to the cam bearing member through the attachment point, and attaching the top elastic element to upper body of the climber, the stepping step comprising at least partially extending the top elastic element, and the lifting step comprising to allow the extended top elastic element to pull the cam upward along the rope.

20. The method of claim 17, wherein the lifting step further comprising having the stiff tether pushing the cam bearing member upwards through the lifting of the foot in addition to the pulling force from the second end of the double bungee elastic piece to unlock the cam and lift up ascender.

* * * * *